US006516729B1

(12) United States Patent
Dodson et al.

(10) Patent No.: US 6,516,729 B1
(45) Date of Patent: Feb. 11, 2003

(54) FREESTANDING COMPANION SYSTEM CONSISTING OF AN ORGANIZER BASE, A TABLE AND THE CONNECTING, SUPPORTING, AND ADJUSTMENT MECHANISMS

(76) Inventors: Robert Leroy Dodson, PMB #869, 713 W. Spruce, Deming, NM (US) 88030; Carol Ann Dodson, PMB #869, 713 W. Spruce, Deming, NM (US) 88030

( * ) Notice: Subject to any disclaimer, the term of this patent is extended or adjusted under 35 U.S.C. 154(b) by 0 days.

(21) Appl. No.: 09/759,572

(22) Filed: Jan. 11, 2001

(51) Int. Cl.[7] ..... A47B 37/00

(52) U.S. Cl. ..... 108/50.11; 108/1; 108/50.12

(58) Field of Search ..... 108/42, 49, 50.01, 108/50.12, 50.02; 297/144, 135, 170, 172, 423.39, 423.4, 423.1

(56) References Cited

U.S. PATENT DOCUMENTS 1,232,757 A * 7/1917 Berkey
1,653,657 A * 12/1927 Pretsch
2,535,112 A * 12/1950 Woody
3,543,312 A * 12/1970 Pofferi
3,698,328 A * 10/1972 Weir ..... 108/49 X
4,512,607 A * 4/1985 Rapp ..... 108/49 X
4,524,484 A 6/1985 Graham
4,744,690 A 5/1988 Hsieh
5,046,206 A * 9/1991 Broyles ..... 108/49 X
5,129,702 A * 7/1992 Ervin ..... 108/49
5,144,898 A * 9/1992 Polsly ..... 108/49 X
5,293,825 A 3/1994 Cauffiel
5,479,865 A 1/1996 Cauffiel
5,503,086 A 4/1996 Hoffman
5,549,052 A 8/1996 Hoffman
5,606,917 A * 3/1997 Cauffiel ..... 108/42
5,606,918 A 3/1997 Cauffiel
5,615,620 A * 4/1997 Owen ..... 108/45
5,839,780 A 11/1998 Cauffiel
5,893,607 A * 4/1999 Trimnell ..... 108/49 X
5,931,102 A * 8/1999 Grahl ..... 108/42
5,967,599 A 10/1999 Cauffiel
6,142,559 A * 11/2000 Sorel et al. ..... 108/49 X

* cited by examiner

*Primary Examiner*—Jose V. Chen

(57) ABSTRACT

A freestanding companion system with an organizational base, table, connecting, holding and adjusting mechanisms for use beside any seating or reclining furniture is disclosed. The base provides ballast for attachments, including a table, and provides areas for storing desired supplies. The connecting devices and mechanisms allow positioning of a table and other attachments in relation to the base and to the seating/reclining furniture. The table has the following adjustment features: it slides from left to right; it is adjustable closer or further away from the user; it is tiltable, past perpendicular; it swivels/rotates about its vertical support; and it is adjustable in height. Accessories can be added to the freestanding companion system at the base, table, and to the upright supports.

7 Claims, 6 Drawing Sheets

FREESTANDING COMPANION SYSTEM CONSISTING OF AN ORGANIZER BASE, A TABLE AND THE CONNECTING, SUPPORTING, AND ADJUSTMENT MECHANISMS

REFERENCE TO A MICROFICHE APPENDIX

Not Applicable

BACKGROUND OF THE INVENTION

The present invention relates to the field of devices to support objects adjacent to a person who is in a seated or reclining position, i.e. convenience tables. More particularly, the present invention relates to convenience tables that are multi-functional, freestanding, adjustable, and attractive.

The field of convenience tables is dominated by devices that are designed for a single purpose or a very narrow range of applications. Examples of such tables are end tables, coffee tables, book holders, foldaway tables that attach to furniture, those for use with hospital beds, craft tables, snack and TV trays. Many of these tables are lightweight and easily tipped.

One of the drawbacks of the support surfaces provided by end tables is the inconvenient location of the table surface relative to an occupant of the seating unit. The table surface of an end table is placed beside rather than directly in front of a seated occupant. The occupant must twist to retrieve a plate or glass from the end table, or twist to eat from the plate placed on the end table.

Use of coffee tables also requires one to lean forward. Even those tables that have a mechanism to move a portion of the coffee table into closer proximity to the user require leaning forward while raising or lowering the moveable portion.

A similar problem exists with the use of snack trays, also called TV trays. The tray legs prevent the user of being able to position the tray close enough to use, for eating, writing, or other activities, without having to lean over. This puts stress on the user's back, causing pain for many people. In order to move the tray to rise from the seat, the user must lift the tray up and forward or twist to the side to re-position it out of the way. Again, this is difficult for many people. Use of a TV tray is also difficult, if not impossible, when seated in a recliner with an extended footrest, or in bed.

Hospital bed trays have an extended support leg that is often too high a profile for most beds in homes, will not work with a water bed at all, and interferes with placement in front of or beside most chairs, especially those with extended footrests.

Book holders are not designed to be supportive of dishes, games, and other objects in a level position.

Craft tables are usually designed with pre-determined bulky cavities that are often not adaptable for other uses.

Foldaway tables must be cleared of all items before being removed from in front of the user. This may require the assistance of a second person, therefore is not an option for many people.

Many of these tables do not provide storage areas for supplies needed for activities, such as magazines or papers, remote controls, writing, art, or eating utensils, an ice bucket, or plants. They also do not provide for the attachment of additional accessories, such as a magnifying glass, a light, an electronic game holder, a phone holder, an umbrella, or fishing rod holder.

Many of these devices are largely utilitarian in design and lack a pleasing appearance. Further, most of these devices are designed for use exclusively inside a living space or business, or are designed exclusively for outdoor use.

An adjustable table as shown in L. Posly, U.S. Pat No. 5,144,898 (expired), has a T-shaped base as ballast with an extension leg that does not fit under or in front of many chairs (rockers, recliners) prohibiting placement of the table top in proper relationship to the user. This table is to be 'mountable' to chairs. The T-shaped base has no other purpose than support.

A cabinet and table assembly for use with seating apparatus shown in F. Cauffiel, U.S. Pat. Nos. 5,967,599 & 5,839,780, and table with movable top surface shown in S. Hoffman, U.S. Pat. Nos. 5,503,086 & 5,549,052, each provide a horizontally disposed table surface in front or beside the user, but no provision is allowed for a tiltable surface for reading or writing.

Tables with base plates shown in F. Cauffiel, U.S. Pat. Nos. 5,606,917, 5,606,918, 5,479,865, and 5,293,825, will be supported only when the base plate is placed under a support of a chair leg (or wheel) and thus will not stand alone. These tables rely upon the weight of a seating apparatus for stabilization and supporting means. These tables will not adapt to use with rocking chairs, lawn chairs, nor chairs on rollers or castors.

A table attached to a chair is shown in D. Ervin U.S. Pat. No. 5,129,702 with a mechanism that is mounted to the bottom frame of the chair, with the table to be stored under the chair, then pulled out and pivoted to a vertical position for use. This table is limited to the chair to which it is bolted, and the mechanism can not be transferred to all designs of chairs, i.e. rockers, platform rockers, four-legged chairs, lawn chairs, wheelchairs, chairs on rollers or castors, nor beds. There are only two basic positions for the table, a fold-away position and vertically extending in front of the chair. The table support leg must be re-positioned from horizontal to vertical for use. Thus it is not designed to be in a ready—to—use position.

Thus, there exists the need for an attractive freestanding companion system with an accessory of a table, that stands alone, that is positional on the left or right side of a multiplicity of seats or reclining furniture, that provides a storage area, that is easily adjusted for height and position, that has a movable table top area that is easily adjusted to a level position, tilted position, shifted right to left, located closer or further from the user, and swivel from in front of the user to the side for ease of movement from a seated or reclining position, without lifting or removing anything on the surface of the table.

SUMMARY OF THE INVENTION

The present invention is a freestanding adjustable convenience system having a fully adjustable table surface, provides a storage area, stands alone with an acceptable degree of stability, is usable on the left or right side of any piece of furniture designed for sitting or reclining, has adjustment mechanisms to change configurations and be re-secured with a minimum of effort, is designed so that other attachments may be easily added, is attractive as an added piece of fliriture, and is suited for use both indoors and outdoors.

The first object of the present invention is to provide a convenience system incorporating a base providing a storage area and a usable table surface for use alone or beside any piece of furniture designed for sitting or reclining.

It is also an object of the present invention to provide such a convenience system that is freestanding, without being attached to a floor, wall, or any other piece of furniture or object, with an acceptable degree of stability.

Another object of the present invention is to provide a convenience system, which provides a usable table surface in both the conventional lateral position of an end table and a position more accessible for an occupant of a seating unit, and to do so without sacrificing the usual functions provided by end tables.

It is an additional object of the present invention to provide a convenience system that is adjustable as to the position of the table surface in reference to the storage unit, adjustable in height, distance from user, and placement on either the left or right hand side.

It is also an object of the present invention to provide a convenience system that has a level table surface.

It is an additional object of the present invention to provide a convenience system that has a table surface that is easily tilted to varying degrees, and even beyond perpendicular.

It is a further object of the present invention to provide a convenience system that has a table surface that is horizontally adjustable, being slideably adjustable from side to side.

It is also an object of the present invention to provide a convenience system that has a table surface that is horizontally adjustable, being adjusted for proximity to user, as in closer or further away.

It is an additional object of the present invention to provide a convenience system that has a table surface that is pivotal about the support means to allow the user to easily swing the table surface out of the way to move to and from the seated or reclining position.

It is also an object of the present invention to provide a convenience system that will provide storage of desired objects.

It is also an object of the present invention to provide a convenience system that is adaptable for additional attachments and other accessories. Some of the accessory items for the table top can include, but not limited to, book holders, page holders, drawers, trays for craft supplies, wrist rests, cup holders, lights or fans, electronic equipment holders, pencil holders, sunshade and table extensions. Other accessories that can be added to the convenience system base are removable liner, lids, self-watering planter, dome plant cover, plant trellis, heaters for plants, wire racks, night light, misting system, wheels. Attachments or accessories that can be attached to the Freestanding Convenience System are umbrella, lights, fishing pole holder, fans, cup holder, mirror, magnifying glass, and many others.

It is also an object of the present invention to provide a convenience system that will stand alone for use as an easel, with the system base providing a storage area for art supplies or a seat with a lid on the base cavity.

It is also an object of the present invention to provide a convenience system that will have adjustment mechanisms futnctional with a minimum of effort.

It is also an object of the present invention to provide a convenience system that is attractive as an added piece of furniture and does not have to be stored when not particularly in use.

It is also a further object of the present invention to provide a convenience system that is suited for use both indoors and outdoors.

REFERENCE NUMERALS IN DRAWINGS

Figure 1:
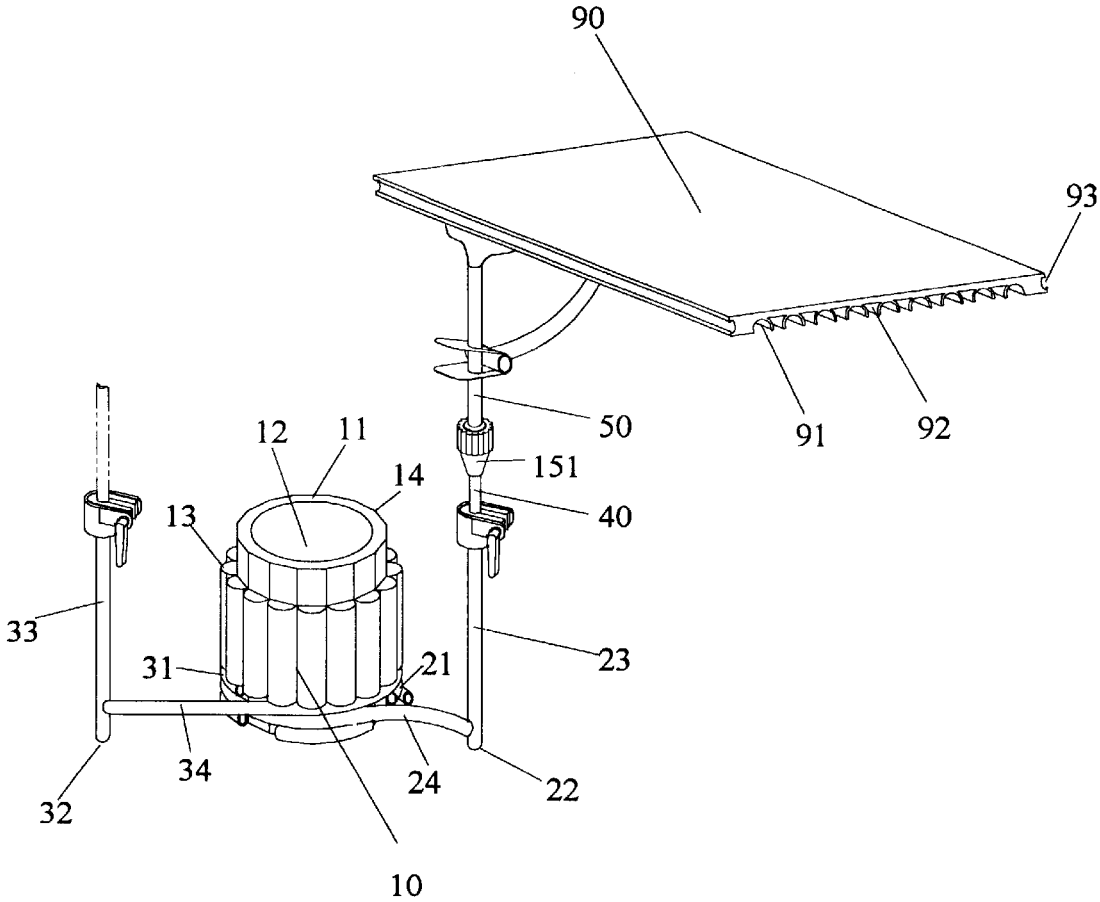
FIG. 1 shows an isometric assembled view of the freestanding companion system.

10 base
11 tower
12 concave cavity
13 ribs
14 points
20 extension apparatus mechanism
21 ring shaped extension section
22 fulcrum point means
23 extension outside telescoping upright
24 extension support section
30 extension apparatus mechanism
31 ring shaped extension section
32 fulcrum point means
33 extension outside telescoping upright
34 extension support section
40 inside telescoping upright
41 bearing surface
50 outside telescoping upright
52 top end of upright 50
57 top end of outside telescoping upright 50
60 linkage
61 upper end of linkage 60
62 crossing segment of linkage 60
70 spring clamp
71 elongated hole of spring clamp 70
72 upper leaf portion of 70
73 lower leaf portion of 70
80 spring support
82 tubular shaped portion of spring support 80
83 circular end of spring support 80
86 spring support
87 loose curved end of 82 and 88
88 tubular shaped portion of spring support 86
89 circular end of spring support 86
90 table
91 elongated clamping members with internal circular channels underneath table 90
92 other—than—circular—shaped grooves underneath table 90
93 slot on edge of table 90
95 tilted position of table 90
110 U-shaped part
111 open ends of part 110
112 open end of part 110
113 spacer
123 adjusting mechanism means
124 handle, locked position
125 handle position, unlocked position
126 inner clamping segment of 123
151 adjusting mechanism means
152 inner section of adjusting mechanism means 151
153 outer section of adjusting mechanism means 151
154 tapered outside surface of 152

155 tapered inside surface of 153
156 threads of adjusting mechanism means 151
200 umbrella accessory shown in phantom
210 unattached chair shown in phantom

DESCRIPTION OF THE INVENTION

The invention, a Freestanding Companion System, comprising of a base, a table, an extension apparatus mechanism, a table support assembly mechanism, a U-shaped part and a spacer, and an adjusting mechanism means.

FIG. 1 shows an assembled view in isometric form of the Freestanding Companion System. The base 10 provides support, stability, and will hold items for personal organization. Base 10 can be manufactured from a number of materials, but must have sufficient mass and weight to provide a low center of gravity and stability for the rest of the invention and attached accessories. Base 10 sets on a floor, or other surface upon which the invention is situated.

Base 10 comprising of a tower 11 that has an inner concave cavity 12 starting at the top and is centered on the tower's axis. The cavity 12 extends down through most of base 10's height with walls that taper toward the center and end at a mostly flat bottom. The outside of the tower 11 of base 10 has half-round cylindrical shapes that create ribs 13 about the tower's diameter. The ribs 13 do not extend to the bottom or the top of the tower 11, and are placed on surfaces of the tower 11 that do extend to the top and bottom of the tower 11. The outside concave surfaces of tower 11 create points 14 to index items, which will be positioned around the outside of the tower 11.

An extension apparatus mechanism (referenced as 20 in FIG. 2) is comprised of an extension outside telescoping upright 23 fixedly attached to a support piece with a ring shaped extension section 21 and an extension support section 24, and an inside telescoping upright 40 affixed telescopically to extension outside telescoping upright 23 with an adjusting mechanism for vertical and/or pivotal positioning. A like extension apparatus mechanism is comprised of an extension outside telescoping upright 33 fixedly attached to a support piece with a ring shaped extension section 31 and an extension support section 34, and an inside telescoping upright 40 affixed telescopically to extension outside telescoping upright 23 with an adjusting mechanism for vertical and/or pivotal positioning. Ring sections like 21 and 31 will slide on and around the bottom of tower 11, with a first ring section bearing on the bottom of ribs 13. Additional ring sections will come to bear on the bottom of the preceding ring section to create a stack of ring sections. Ring sections can also be placed above the ribs. Support pieces like 21/24 and 31/34 can be a flat plate cut in a ring shape, a solid bar or square bar or tubing bent into a ring shape. Figures show these support pieces as a solid bar.

The extension apparatus mechanisms are rotationally encircling base 10 so that attachments are moved rotationally about the axis of base 10 for positioning. Such attachments include the table and other accessory items, such as, but not limited to, an umbrella or document holder.

The number of extension apparatus mechanisms that can be stacked around tower 11 depends on the ring sections vertical thickness and the length of the ribs 13.

Each extension apparatus mechanism has a fulcrum point means, such as 22 and 32, at lowest end of the extension outside telescoping upright that makes contact with the floor or other surface upon which the invention is placed, that leverages and increases the effectiveness of base 10 to aid in the stability of all uprights and their attachments, of the table, and any objects which may be placed on or attached to the table or into any of the channels, grooves, or slots of the table.

The table 90 is supported by an extension apparatus mechanism, by means of the telescoping uprights 40 and 50 and attached supports. The table 90 can be manufactured from a number of materials. Lighter weight materials will prevent an overload for the base and connecting mechanisms. The table 90 underneath surface has a series of elongated clamping members with an internal circular channel 91 to entrap a table support assembly mechanism, as well as of additional accessories. The items entrapped in channels 91 will slide inside the channels and will rotate about the axis of channels 91.

A series of other—than—circular—shaped grooves 92 underneath table 90 between channels 91 will entrap a non-rotating attachment mechanism means of accessories that will slide and will not rotate. Such accessories might include, but are not limited to, a pencil drawer, a cup holder, a document holder.

Edge slot 93 of table 90 will entrap a non-rotating attachment mechanism means of accessory items that will allow these items to slide in the slot, but will not rotate on axis of the slot. Such accessories might include, but are not limited to, a cup holder, a magnifying glass, a document holder, a light, a fan.

Channels 91, grooves 92, and slots 93 start on one side of a table 90 and continue to the opposite side in a straight line.

FIG. 1 further illustrates the Freestanding Companion System to be assembled in such a manner as to be positioned on either the left or right side of a person in any seated or reclining position. The design provides an acceptable degree of stability and allows the invention to be used alone or near any seat, and is especially adaptable beside reclining chairs and beds.

Figure 2:
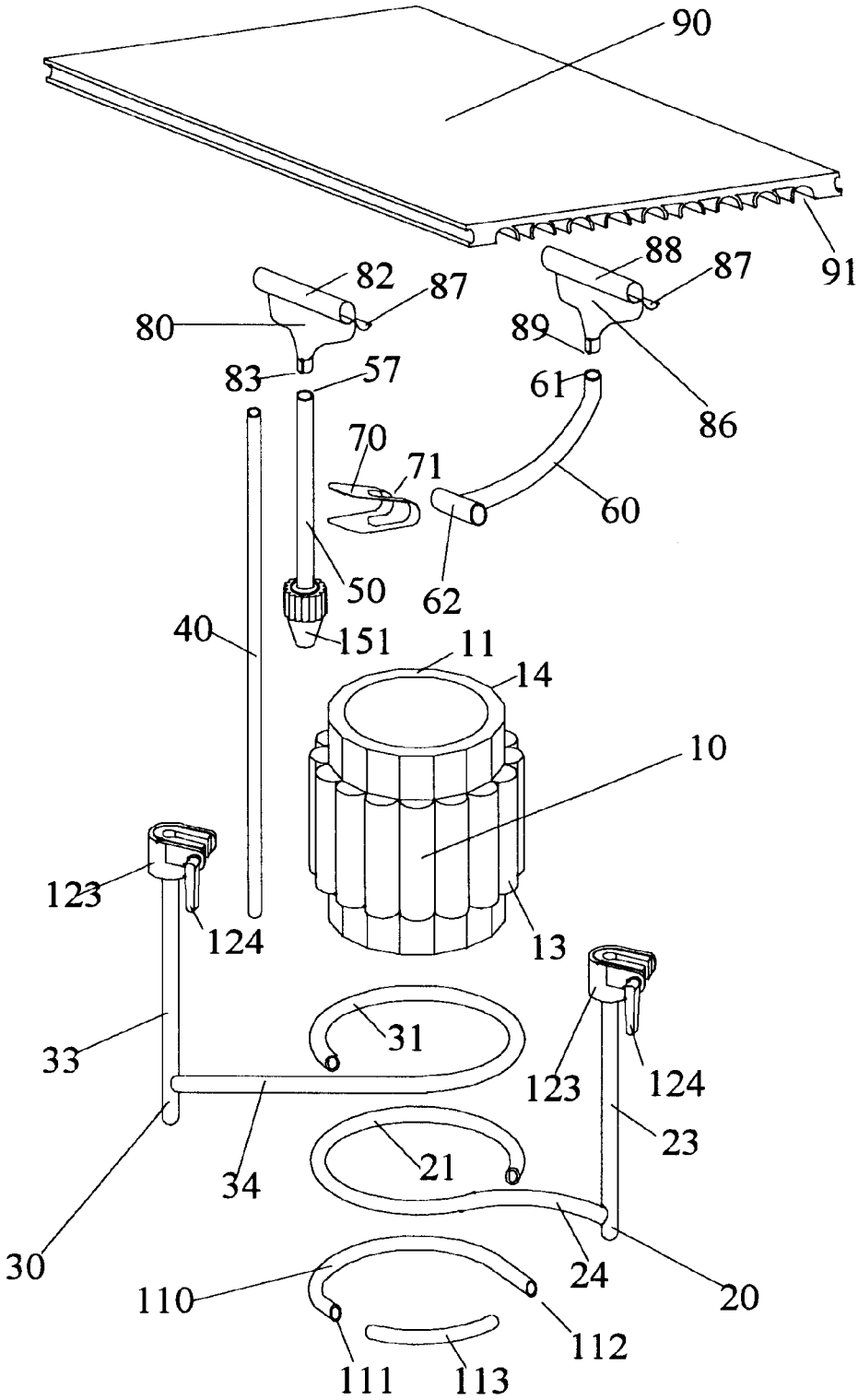
FIG. 2 is an isometric exploded view of the parts comprising the freestanding companion system.

FIG. 2 shows an exploded view, in the isometric form, of individual parts. The individual segments of extension apparatus mechanisms 20 and 30 are more visible.

The ring sections like 21 and 31 will slide over and around the bottom of tower 11 of base 10, until they come to bear on the bottom of ribs 13 and will be indexed into place by the points 14. This will make less friction for ring sections like 21 and 31 to rotate, since the amount of material making contact between the ring sections and the tower 11 is minimized. To entrap the ring sections like 21 and 31 under the ribs 13, the U-shaped part 110 and spacer 113 are secured to the tower 11 on the same plane and in such a manner as to create an entrapping area to hold the ring sections in place and minimize the clearance between the contact surfaces of the U-shaped part 110, spacer 113, the ring sections like 21 and 31 and the bottom ends of the ribs 13, without restricting the independent rotation of the ring sections about the axis of base 10.

The open ends 111 and 112 of the U-shaped part 110 will allow for additional attachment of accessories, such as, but not limited to, a second base, wheels and handles for movement of the invention, additional tables on both sides of the seated or reclining person, or bracing to increase the stability of the freestanding companion system, including the table and accessories.

The inside telescoping upright 40 is inserted into vertical support members like extension outside telescoping uprights 23 and 33 by passing through the opening in an adjusting mechanism means 123.

The adjusting mechanism means 123 is secured to the upper end of vertical support members like extension outside telescoping uprights 23 and 33. When the handle 124 is in the closed position, then the inside telescoping upright 40 is held at a set height until a readjustment is executed. The pictured adjusting mechanism means 123 is fashioned after U.S Pat. No. 4,744,690 to Hsieh, which is public domain.

An adjusting mechanism means 151, which is secured to the bottom end of outside telescoping upright 50, is slid over the top end of inside telescoping upright 40. The relaxing of the braking action of adjusting mechanism means 151 with a twisting action allows for the rotation of the table 90 around the common axis of telescoping uprights 40 and 50. The pictured adjusting mechanism means 151 is fashioned after U.S. Pat. No. 4,524,484 to Graham, which is public domain.

A table support assembly mechanism comprising spring support 80, spring clamp 70, linkage 60, spring support 86, outside telescoping upright 50 and supporting table 90 will travel along with and horizontally around the vertical axis of inside telescoping upright 40. The assembly of linkage 60 with the spring clamp 70 is accomplished by inserting the upper end 61 of linkage 60 through the elongated hole 71 in spring clamp 70 before securing the lower circular end 89 of spring support 86 to the upper end 61 of linkage 60. The outside telescoping upright 50 is inserted through that same elongated hole 71 of spring clamp 70 in such a manner as to create a 90° angle between outside telescoping upright 50 and crossing segment 62 of linkage 60 before the top end 57 of outside telescoping upright 50 is closed off with the attachment of spring support 80 by securing the circular end 83 to outside telescoping upright 50. Spring supports 80 and 86 can be made out of several materials, such as wire or sheet from a springy metal or plastic type material.

The tubular shaped portions 82 and 88 of spring supports 80 and 86 and the segment 62 of linkage 60 are shown in a parallel pattern. This may not always be the case in all applications. If circular ends 83 and 89 are rotated equally before being secured to upper ends of outside telescoping upright 50 and linkage 60, then the segment 62 will be other than parallel to 83 and 89, changing the location of spring clamp 70 in relationship to the user. This would have the effect of changing the reach for a person to execute the tilt of the table. Either one or both of the spring supports 80 and 86 can be rotated about their axis 83 and 89 to change the position of the loose curved end 87 in relationship to the user.

Figure 3:
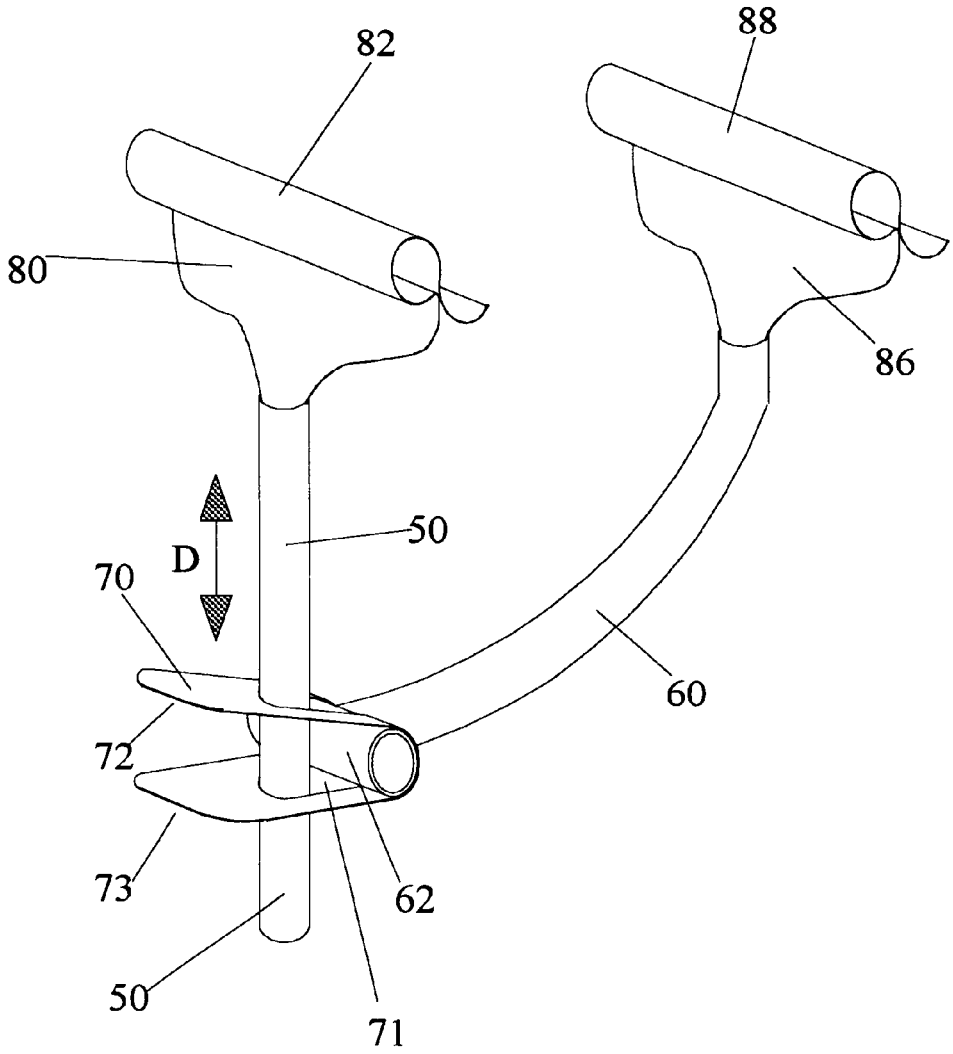
FIG. 3 is an enlarged isometric view of the parts that move in order to tilt the table.

The enlarged isometric assembly view, FIG. 3, shows that when both linkage 60 and the outside telescoping upright 50 are inserted through the elongated hole 71, so that crossing segment 62 and outside telescoping upright 50 are at 90° angles to each other as shown, they will be kept tightly held with the tension of spring clamp 70, which always tries to spring the leaves 72 and 73 further apart. Spring clamp 70 can be made out of several materials, such as wire or sheet from a springy metal or plastic type material.

When the tension of spring clamp 70 is relaxed by moving the leaves 72 and 73 toward each other with a pinching action, the entrapped crossing segment 62 is loosely attached to outside telescoping upright 50. The relaxed spring clamp 70 and crossing segment 62 will travel together vertically, as indicated by Arrows D, up or down outside telescoping upright 50, which will pull or push linkage 60 and the spring support 86. This pulling or pushing will force the table to rotate about the common axis of the tubular shaped portion 82 of spring support 80, and the circular channel 91 in which it is placed on the underneath side of the table, to a different position. The tubular shaped portion 88 of spring support 86 will also rotate inside the circular channel 91 on the bottom of the table in which it is placed. The crossing segment 62 will rotate about its axis inside of spring clamp 70. This series of rotations will bring the table to a different angle of tilt.

Figure 4:
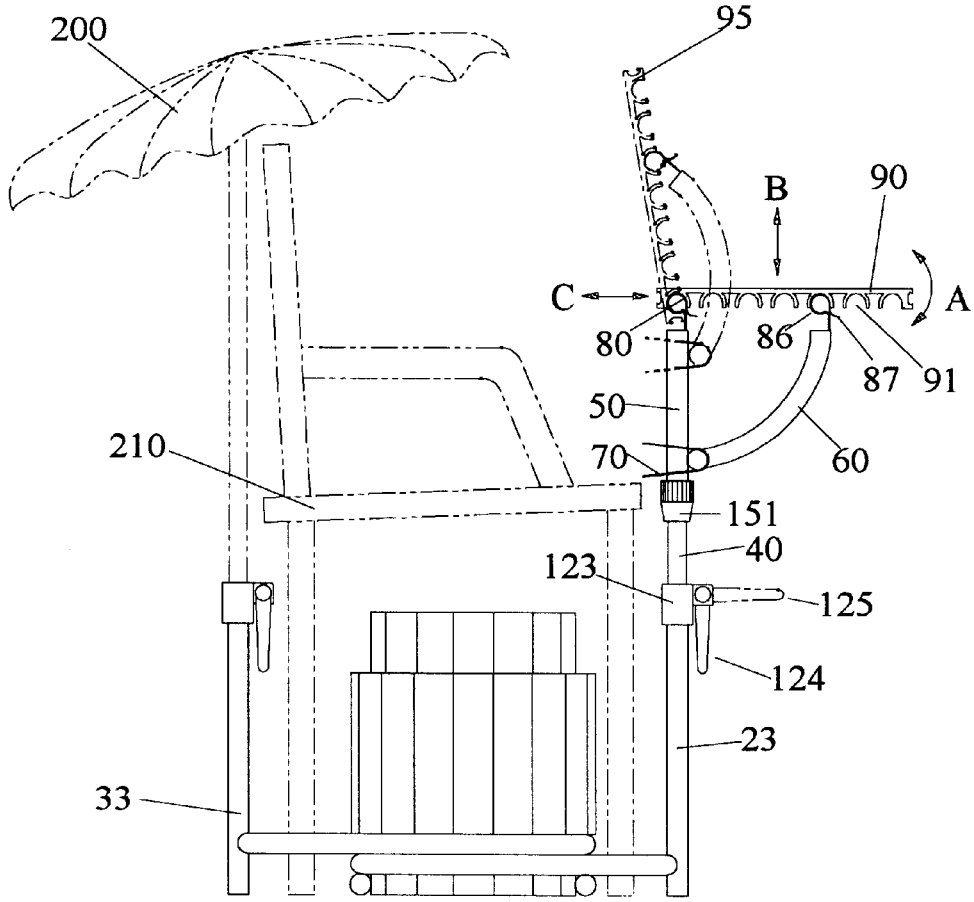
FIG. 4 is a side view of the freestanding companion system, as the table would be positioned in front of a person seated in chair.

FIG. 4 shows a view of the Freestanding Companion System placed to the right side of an unattached chair 210 shown in phantom, along with accessory umbrella 200, shown in phantom behind chair 210 and inserted in the extension outside telescoping upright 33. Table 90 is shown in front of the seat of the chair 210. Shown in FIG. 4 are the above mentioned parts to make the adjustment of table 90 from a horizontal plane, as shown, to a tilted position 95 as indicated with Arrow A, and to adjust the table 90 height as indicated with Arrow B.

FIG. 4 shows table 90 in its normal position with its top surface parallel to the floor, or other surface on which the invention is located. The tilted position 95 shown in phantom of table 90, where the table is rotated around the axis of the tubular shaped portion of spring support 80 to the point that the table top surface is beyond perpendicular to the floor, is obtained by moving spring clamp 70 near the top of outside telescoping upright 50, as shown in phantom. The angle of tilt can be stopped at any location between the horizontal position 90 and the tilt position 95. The rotation of table 90 can also be tilted by moving spring support 86 of linkage 60 to another channel 91 that is closer to spring support 80.

Adjusting the height of table 90 is accomplished by releasing the braking action of adjusting mechanism means 123 by swinging the handle from the locked position 124 to the unlocked position 125 shown in phantom. This will loosen the friction grip of the adjusting mechanism means 123 so that the inside telescoping upright 40 will freely move up or down through extension outside telescoping upright 23 in a telescoping manner. After the desired table height is achieved, it is secured by re-tightening the adjusting mechanism means 123 by returning the handle to position 124.

Table 90 is rotated about the common axis of uprights 23, 40 and 50 while retaining the same plane that is parallel to the floor, by releasing the braking action with a twisting of the adjusting mechanism means 151 and reversing the twisting action to re-tightening the adjusting mechanism means once the table has been rotated to a desired position.

The adjustment, indicated with Arrow C, of table 90, shown in a horizontal plane, toward or away from a person seated in a chair 210 adjacent to the invention, is provided by selecting the appropriate circular channels 91 into which spring supports 80 and 86 are placed.

The outside telescoping upright 50 and linkage 60 are connected to the table 90 with spring supports 80 and 86 that fit tightly inside any of the table circular channels 91 because of the tubular shaped portion 88 trying to spring to a larger diameter. The spring support 80 is secured to the top end of outside telescoping upright 50. The spring support 86 is secured to the top end of linkage 60.

Spring supports 80 and 86 are each released from the tension inside any of the circular channels 91, by pulling down on the loose curved end 87 in order to slide them in or out, or side—to—side of any of the circular channels 91. The sides of circular channels 91 will be flexible enough to assist the spring supports 80 and 86 or other rigid circular items to slip from side—to—side or snap in—and—out.

Many types of public domain hardware, such as snap buttons, braking clamps, friction clamps, and spring clamps can perform the same or similar function as adjusting mechanism means 123 and 151 and spring clamp 70.

Figure 5:
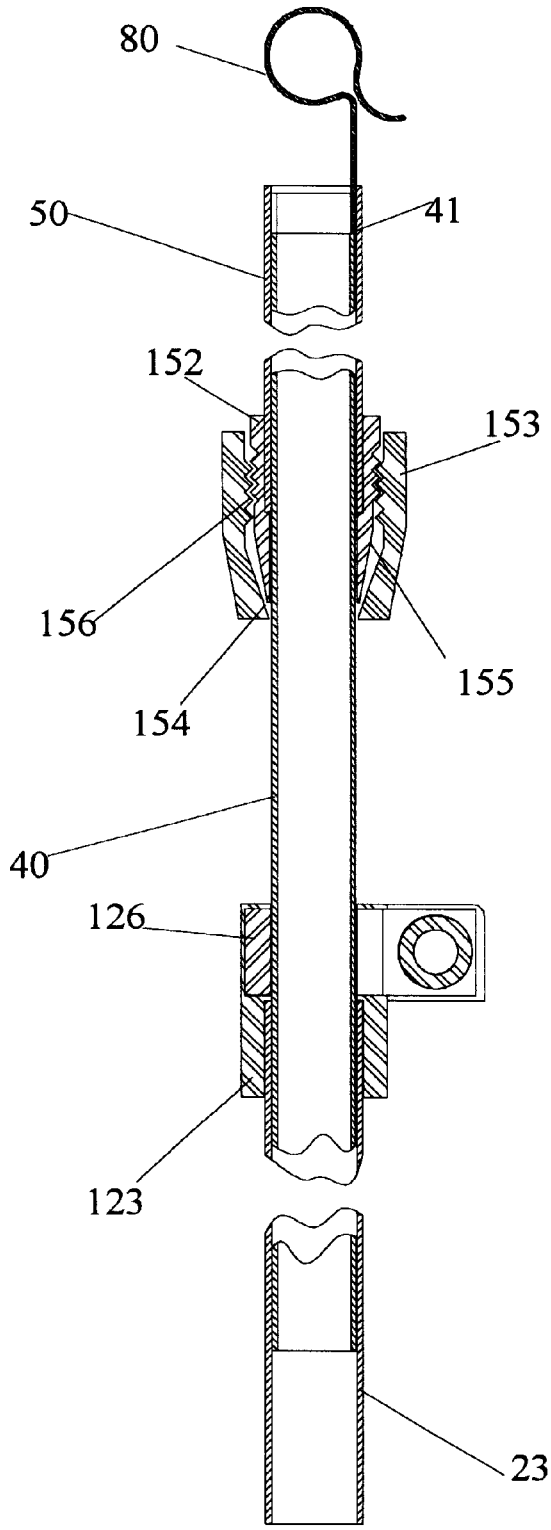
FIG. 5 is an enlarged cut through view of the telescoping, rotating and clamping parts of the mechanisms.

The adjusting mechanism means 151 shown in FIG. 4 is shown in FIG. 5 as inner segment 152 and an outer segment 153. The rotation of the table is achieved by the twisting of segment 153 of the adjusting mechanism means 151, so that it rotates on the threads 156 and relaxes the braking action.

The cut through view in FIG. 5 reveals that outside telescoping upright 50 extends some distance into segment 152 where they are secured to each other. Segment 153, which is threaded over and around segment 152, has a braking action around inside telescoping upright 40 because the tapered outside surfaces 154 of segment 152 will make contact with the tapered inside surfaces 155 of segment 153, when segment 153 is twisted on the threads 156.

FIG. 5, an enlarged cut though view, also reveals a bearing surface 41 for rotation that is created and maintained by gravity where the bottom of spring support 80 and the top of inside telescoping upright 40 meet inside of outside telescoping upright 50.

The cut through view of adjusting mechanism means 123 also reveals that extension outside telescoping upright 23 extends into and is affixed to the interior of adjusting mechanism means 123. The inner clamping segment 126 is around inside telescoping upright 40 and will loosen with the relaxing action of the handle of adjusting mechanism means 123. The table is adjusted in height and rotated with the adjusting mechanism means 123. When the desired position is obtained, the handle of the adjusting mechanism means 151 is reversed to a tightening position and that will maintain the desired height.

Figure 6:
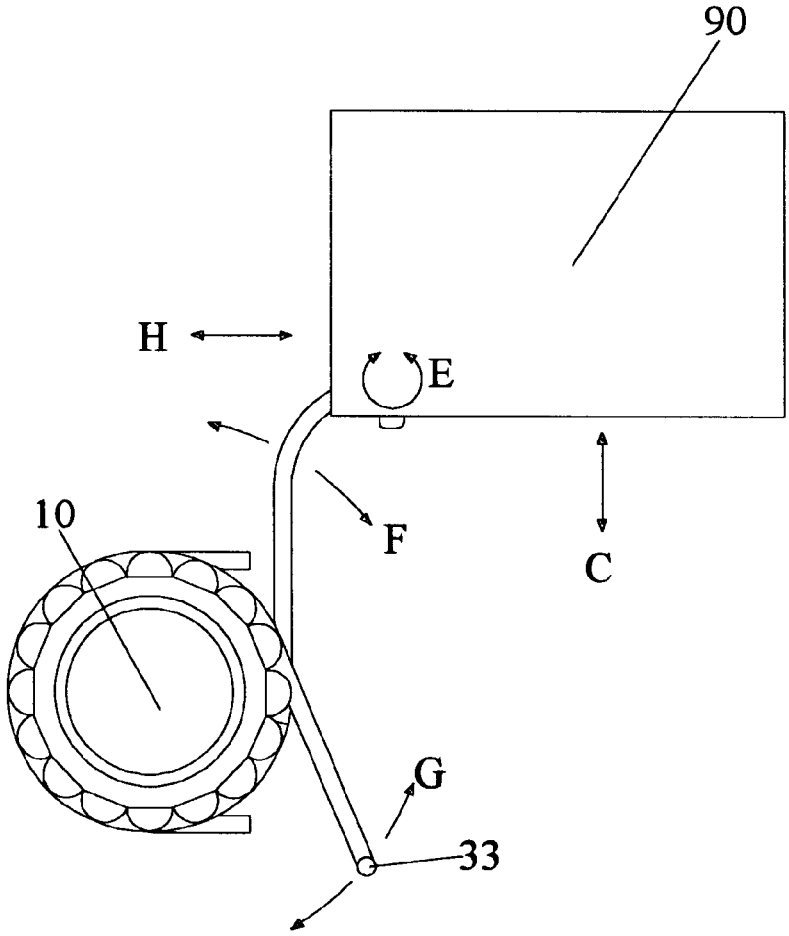
FIG. 6 is a top view indicating various movements of the freestanding companion system.

FIG. 6 is a top view of the Freestanding Companion System, as the base 10 would be situated to the left of the user and the table 90 situated in front of the user, that further illustrates the options of the orientation of the extension apparatus mechanisms 20 and 30 and of table 90 to base 10. The attachment of the telescoping uprights and support to the table 90 allows movement rotationally about the common upright axis's of the uprights as previously discussed and is indicated by Arrows E. The movement of table 90 along with the extension apparatus mechanism 20, rotationally around the axis of base 10 as indicated by Arrows F was previously described.

In like manner, extension outside telescoping upright 33 rotates about the axis of base 10 as indicated by Arrows G was previously discussed. The movement inward and outward from a seated or reclining person as indicated by Arrows C was previously described.

Table 90 is moved from side—to—side in a horizontal plane as indicated by Arrows H with slide adjustment means by changing the location of the spring supports 80 and 86 in channels 91 under the table 90, which has been previously discussed.

In summary, a freestanding companion system is assembled with one or more extension apparatus mechanisms placed with the ring shaped section around the bottom of the tower shaped base below the ribs.

The U-shaped part and spacer are then secured to the base directly below the ring or stack of rings. The ring or stack of rings are trapped between the ribs of the base and the U-shaped part and spacer in such a manner as to allow the ring or rings to rotate about the base independently of one another.

The inside telescoping upright is affixed telescopically into the extension outside telescoping upright of the extension apparatus mechanism with an adjusting mechanism for pivotal and/or vertical positioning.

Then the choice is made of which attachment to affix. Options include, but are not limited to, an umbrella, a document holder, a table with the table support assembly mechanism, or other attachments.

When a table is chosen, the adjusting mechanism means of the table support assembly mechanism is placed over the inside telescoping upright of the extension apparatus mechanism providing a second independent pivotal adjustment about the common axis of the telescoping uprights.

This second adjusting mechanism means enables the table and the table support assembly mechanism to rotate about the common axis of the vertical uprights as a separate independent adjustment from the vertical adjustment.

After assembly the freestanding companion system is ready for immediate use as an organizer for multiple items, an easel, a document/book holder, or a display table. It is also ready to be positioned near any chair, couch, bed, hammock, or lawn furniture, in a home, office, waiting room, or outside, with the storage area in the base for needed supplies and for personal items, as desired by the user. This is a freestanding companion system that can be used by any person, whether standing, seated, reclining, or laying down.

Although only one configuration of the invention is shown and described in the figures, the invention is not limited to the above description and includes a variety of specific designs. It is believed apparent that the invention is not necessarily confined to the specific use described above, since it may be utilized for any purpose to which it may be suited. Nor is the invention necessarily limited to the specific construction illustrated and described, since such construction is only intended to be illustrative of the principles of operation, it being considered that the invention comprehends any minor change.

That which is claimed is:

1. A freestanding companion system comprising (a) a base having a low-center of gravity and being of sufficient weight to provide adequate ballast for all items linked to said base, said base being a tower with an inner concave cavity starting at top of said tower and ending at a mostly flat bottom, said cavity centering on the tower is vertical axis extending substantially into the said tower, the cavity walls tapering toward the center of the cavity said tower cavity creating a storage area means fpr holding personal items said tower having half-round cylindrical shapes creating vertical ribs situated about the tower's outer diameters in a predetermined spacing between the top and bottom of said tower, said tower having an area above said vertical ribs for horizontal placement of at least one of an extension apparatus mechanism, said tower having an area below said vertical ribs for horizontal placement of at least one of said extension apparatus mechanism, said tower having outside concave surfaces creating indexing point means so as to minimize contact between said extension apparatus mechanism and said tower of said base, (b) said extension apparatus mechanism including adjusting structure to connect to the base to an attachment, said extension apparatus mechanism and said base to provide support means for said attachments, (c) an attachment of an accessory, being a table having a top surface, an underneath surface and an edge surface, said underneath surface comprising a plurality of elongated clamping members aligned with a predetermined separation, said clamping members having an internal circular channel for releasably entrapping attachment mechanism means and allowing said attachment mechanism means to move in said channel with slide adjustment means and to rotate about the horizontal axis of said channel, said table being by said slide adjustment means, said table being connected to at least one vertical support member of said extension apparatus mechanism with an adjusting mechanism means providing adjustable vertical positioning said table being tiltabfe to a desired angle with respect to horizontal plane, even beyond perpendicular, with a table support assembly mechanism means supporting said table to said extension apparatus mechanism connected to said base, said table having pivotal positioning about said vertical support member with said adjusting mechanism means, said table being positional in proximity to a user, as in closer or further away, with said table support assembly mechanism means, said table being positional to beside said user with said adjusting mechanism means, with all adjustments being made easily and fixed securely, (d) a U-shaped part and a spacer, secured to lower outer portion of said base below said extension apparatus mechanisms for retaining means of a multiplicity of said extension apparatus mechanisms and additional attachment of accessories, said retaining means permitting unencumbered rotational movement of said extension apparatus mechanisms and said attachments around said base, open ends of said U-shaped part allowing for additional attachment of accessories, whereby the combination of said base, said extension apparatus mechanisms, said table support assembly mechanism, said table, and said U-shaped part and spacer and said adjusting mechanism means provide a freestanding usable storage area and convenient adjustable adaptable positional working, eating, or playing surface that can be used alone, or can be located near a chair or a lounging surface for a person in various seated or reclining positions and whereby the combination of said base, said extension apparatus mechanism, said table support assembly mechanism, said table, and said U-shaped part and spacer and said adjusting mechanism means can be assembled for use on either the right or left side of said person in various standing, seated or reclining positions.

2. A freestanding companion system of claim 1, wherein said extension apparatus mechanism comprising (a) a support piece with an extension support section and a ring shaped extension section rotationally encircling said area above or below said ribs of said tower of said base, said ring shaped extension section permitting rotational positioning of said extension apparatus mechanism and said table, said accessory or any said attachment to said extension apparatus mechanism to a multiplicity of positions by sliding rotationally around the vertical axis of said base, (b) an extension outside telescoping upright being an interacting telescoping member fixedly attached to said extension support section, (c) an inside telescoping upright being an interacting telescoping member affixed telescopically to said extension outside telescoping upright with said adjusting mechanism means for plurality of positioning orientations of said attachments, said table, said table support assembly mechanism means, or said accessories relative to said base, (d) a fulcrum point means created at lowest end of said extension outside telescoping upright, which rests on a floor, whereby said extension apparatus mechanism and said adjusting mechanism means provides support means for said attachments, such as said attachments, said table support assembly mechanism, said accessories, and said table, and provides rotational adjustable of said attachments, said table, and said accessories around said base, being positional to in front of or to a multiplicity of positions beside said user, whereby said adjusting mechanism means provides plurality of positioning as to vertical orientation or pivotal orientation of said base to said attachments, said table support assembly mechanism, said table, and said accessories, whereby combination of said support piece with said extension support and said ring shaped extension section, said extension outside telescoping upright, said inside telescoping upright, said fulcrum point, and said adjusting mechanism means provides a stable, adjustable, positional connection between said base, said table support assembly mechanism, and said table, said attachment or said accessory, and whereby the combination of said base, said extension apparatus mechanisms, said table support assembly mechanism, said table, and said U-shaped part and spacer, with said adjusting mechanism means provide a freestanding usable storage area and convenient adjustable adaptable working, eating, or playing surface that can be used alone, or can be located near a chair or a lounging surface for a person in various seated or reclining positions.

3. A freestanding companion system as set forth in claim 2, wherein said table support assembly mechanism comprising (a) a spring clamp of a U-shaped configuration with an upper leaf portion, a lower leaf portion and an elongated hole in elbow area, (b) a linkage comprising a curved segment with a crossing segment, (c) an outside telescoping upright supporting said linkage held in said spring clamp and connected to an upright supported by said base and connecting devices, (d) an attachment mechanism means of a spring support, comprising a lower circular end and an upper loosely curved end of a tubular shaped portion releasably entrapped in said internal circular channel on said underneath surface of said table, said spring support providing axial rotation and slide adjustment means of said table for tilting and horizontal positioning, said table being positional in proximity to a user, as in closer or further away, by selected position of said spring supports in said channels of said underneath surface of said table, (e) an attachment mechanism means of a second spring support comprising a lower circular end and an upper loosely curved end of a tubular shaped portion attached to top end of said outside telescoping upright which said spring support is releasably entrapped in a second internal circular channel on said underneath surface of said table, said spring support providing axial rotation and slide adjustment means of said table for tilting and horizontal positioning, said table being positional in proximity to a user, as in closer or further away, by selected position of said spring supports in said channels of said underneath surface of said table, (f) an adjusting mechanism means affixed to bottom of said outside telescoping upright, said adjusting mechanism means affixed to top of said inside telescoping upright of said extension apparatus mechanism so as to provide a plurality of positional orientations of table support assembly mechanism to said inside telescoping upright, whereby said table support assembly mechanism holds said table in a plurality of discrete relative positions, level or tilted, determined by choice of said channels into which said spring supports are located and location of said spring clamp on said outside telescoping upright, and whereby as said upper leaf portion and lower leaf portion of said spring clamp are pinched said spring clamp is relaxed allowing said table support assembly mechanism to be raised or lowered along said outside telescoping upright permitting said table position to be adjustable as to level or tilted, even to perpendicular, in reference to said user, and a desired position is secured again with the tightening of said spring clamp by releasing said upper leaf and said lower leaf permitting said spring clamp to again apply tension, whereby said adjusting mechanism means affixed to bottom of said outside telescoping upright of table support assembly mechanism affixed to top of said inside telescoping upright of said extension apparatus mechanism provides a plurality of positional orientations of table support assembly mechanism to said inside telescoping upright so as to allow pivotal adjustment about said uprights, and whereby said adjusting mechanism means affixed to bottom of said outside telescoping upright of table support assembly mechanism affixed to top of said inside telescoping upright of said extension apparatus mechanism provides a plurality of positional orientations of table support assembly mechanism to said inside telescoping upright so as to allow vertical adjustment about said uprights.

4. A freestanding companion system of claim 1, wherein said underneath surface of said table further comprising alternately in areas between said elongated clamping members other—than—circular grooves of a pattern for entrapping slideable non-rotating attachment mechanism means that will slide but not rotate about axis of said groove so as to attach said accessories to said table.

5. A freestanding companion system of claim 1, wherein said edge of said table connecting said top surface and said underneath surface, having slots on said edges parallel to said elongated clamping members for securing said accessories, and said slots being of other than circular in shape so non-rotating attachment mechanism means will slide but not rotate about the axis of said slot so as to attach said accessories to said table.

6. A freestanding companion system comprising (a) a base having a low-center of gravity and being of sufficient weight to provide adequate ballast for all items linked to said base, said base being a tower with an inner concave cavity starting at top of said tower and ending at a mostly flat bottom, said cavity centering on the tower's axis extending substantially into said tower, the cavity walls tapering toward the center of the cavity said tower cavity creating a storage area means for holding personal items, said tower having half-round. cylindrical shapes creating vertical ribs situated about the tower's outer diameter in a predetermined spacing between the top and bottom of said tower, said tower having an area above said vertical ribs for horizontal placement of at least one of an extension apparatus mechanism, said tower having an area below said vertical ribs for horizontal placement of at least one of said extension apparatus mechanism, said tower having outside concave surfaces creating indexing point means so as to minimize contact between said extension apparatus mechanism and said tower of said base, (b) an extension apparatus mechanism horizontally adjustable along said horizontal axis to an attachment of an accessory, said extension apparatus mechanism and said base to provide support means for said attachments, (c) an accessory being connected to at least one vertical support member of said extension apparatus mechanism with an adjusting mechanism means providing adjustable vertical positioning said accessory having pivotal positioning about said base with said adjusting mechanism means, said accessory being positional in proximity to a user, as in closer or further away, by positioning of said extension apparatus mechanism, said accessory being positional to beside said user with said adjusting mechanism means, with all adjustments being made easily and fixed securely, (d) a U-shaped part and a spacer, secured to lower outer portion of said base below said extension apparatus mechanisms for retaining means of a multiplicity of said extension apparatus mechanisms and additional attachment of accessories, said retaining means permitting unencumbered rotational movement of said extension apparatus mechanisms and said attachments around said base, open ends of said U-shaped part allowing for additional attachments of accessories, whereby the combination of said base, said extension apparatus mechanism, said accessory and said Ush-aped part and spacer, with said adjusting mechanism means, provide a freestanding usable storage area and convenient adjustable adaptable working, eating, or playing surface that can be used alone, and can be located near a chair or a lounging surface for a person in any seated or reclining position, and whereby the combination of said base, said extension apparatus mechanism, said accessory and said U-shaped part and spacer, with said adjusting mechanism means, can be assembled for use on either the right or left side of said person in various standing, seated or reclining positions.

7. A freestanding companion system of claim 6, wherein said extension apparatus mechanism comprising (a) a support piece with an extension support section and a ring shaped extension section rotationally encircling said area above or below said ribs of said tower of said base, said ring shaped extension section permitting rotational positioning of said extension apparatus mechanism and said table, said accessory or any said attachment to said extension apparatus mechanism to a multiplicity of positions by sliding rotationally around the vertical axis of said base, (b) an extension outside telescoping upright being an interacting telescoping member fixedly attached to said extension support section, (c) an inside telescoping upright being an interacting telescoping member affixed telescopically to said extension outside telescoping upright with said adjusting mechanism means for vertical and pivotal positioning of said attachments or said accessories relative to said base, (d) a fulcrum point means created at lowest end of said extension outside telescoping upright, which rests on a floor, whereby said extension apparatus mechanism provides support means for said attachments or said accessories, and providing rotational adjustable of said attachments and said accessories around said base, being positional to in front of or to a multiplicity of positions beside said user, and whereby combination of said ring shaped extension section, said extension support, said extension outside telescoping upright, and said fulcrun point, with said adjusting mechanism means, provides a stable, adjustable, positional connection between said base and said attachment or said accessory.

* * * * *

UNITED STATES PATENT AND TRADEMARK OFFICE

CERTIFICATE OF CORRECTION

PATENT NO. : 6,516,729 B1 
DATED : February 11, 2003
INVENTOR(S) : Dodson et al.

It is certified that error appears in the above-identified patent and that said Letters Patent is hereby corrected as shown below:

Column 2,
Line 61, "fliriture" should read -- furniture --

Column 3,
Line 55, "futnctional" should read -- functional --

Column 10,
Line 44, "tower is vertical axis" should read -- tower's vertical axis --
Line 46, insert -- , -- between "cavity" and "said"
Line 47, "fpr" should read -- for --
Line 48, insert -- , -- between "items" and "said"

Column 11,
Lines 6-7, "said table being by said slide adjustable means" should read -- said table being horizontally adjustable along said horizontal axis by said adjustable means, --
Line 11, "tiltabfe" should read -- titlable --

Column 14,
Line 18, insert -- , -- between "positioning" and "said"

Signed and Sealed this

Ninth Day of September, 2003

JAMES E. ROGAN
*Director of the United States Patent and Trademark Office*